United States Patent [19]

Mita et al.

[11] Patent Number: 4,851,082

[45] Date of Patent: Jul. 25, 1989

[54] PULPING PROCESS

[75] Inventors: Akio Mita; Akio Dobashi, both of Tokyo; Susumu Kashiwabara, Hino, all of Japan

[73] Assignee: Director General of Agency of Industrial Science and Technology, Japan

[21] Appl. No.: 158,776

[22] Filed: Feb. 22, 1988

[30] Foreign Application Priority Data

Apr. 22, 1987 [JP] Japan ..... 62-097262
Nov. 19, 1987 [JP] Japan ..... 62-290680

[51] Int. Cl.[4] ..... D21C 3/20

[52] U.S. Cl. ..... 162/76; 162/78; 162/80; 162/90; 162/91; 162/98; 162/99

[58] Field of Search ..... 162/98, 99, 91, 76, 162/78, 90, 80, 72

[56] References Cited

U.S. PATENT DOCUMENTS

| | | | |
|---|---|---|---|
| 1,866,917 | 7/1932 | Worden | 162/24 |
| 2,457,856 | 1/1949 | Zeehuisen | 92/10 |
| 2,883,826 | 4/1959 | Smith et al. | 57/164 |
| 4,106,979 | 8/1978 | Ruffini et al. | 162/98 X |

*Primary Examiner*—David L. Lacey
*Assistant Examiner*—Thi Dang
*Attorney, Agent, or Firm*—Lorusso & Loud

[57] ABSTRACT

A process for the production of a pulp from bast fibers, which includes reacting a mixture of the bast fibers and an aqueous digestion liquid at a temperature of 60°-130° C. The digestion liquid includes (a) hydrogen peroxide or a compound capable of generating hydrogen peroxide in the presence of water, (b) an alkali metal carbonate, and (c) an oxalate.

14 Claims, 1 Drawing Sheet

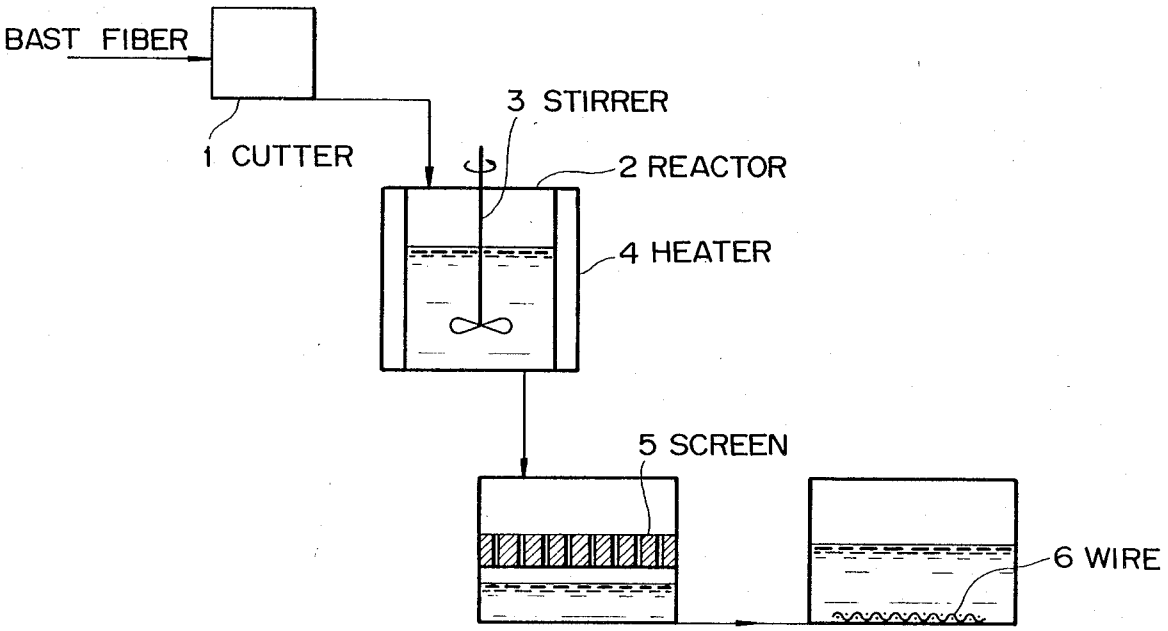
BAST FIBER
1 CUTTER
3 STIRRER
2 REACTOR
4 HEATER
5 SCREEN
6 WIRE

PULPING PROCESS

This invention relates to a pulping method and, more specifically, to a method of producing a pulp from bast fibers such as mitsumata and hemp.

Bast fibers of mitsumata, hemp or the like plants are formed of pecto-cellulose and a small amount of lignin. These fibers have thus far been pulped by a method including the steps of digesting the raw fibers with an alkali-containing digestion liquid to obtain a crude pulp, and bleaching the crude pulp with a chlorine bleaching agent. The conventional method, however, requires a long period of time for digestion and bleaching. Another problem associated with the known pulping method is that it causes environmental pollution because of the use of bleaching agent.

The present invention is aimed at the provision of a pulping method in which the above problems of the conventional method are overcome and by which a pulp with a high brightness can be produced within a short period of time without post treatments such as maceration and bleaching treatments.

In accomplishing the foregoing objects, there is provided in accordance with the present invention a process for the production of a pulp, comprising reacting a mixture of a bast fiber material and an aqueous cooking liquor at a temperature of 60°–130° C., said cooking liquor including (a) hydrogen peroxide or a compound capable of generating hydrogen peroxide in the presence of water, (b) an alkali metal carbonate, and (c) an oxalate.

The term "bast fiber material" used in the present specification is intended to refer to (1) a fibrous resource obtained by removing an epidermis from a bast of a plant such as mitsumata (Edgeworthia chrysantha), a paper mulberry, Wikstroemia sikokiana or Brossonetia kajinoki and (2) bast fibers of a flax (Linum usitatissimum) such as hemp, flax-plant, jute, ramie or sisal. Both raw bast fibers and refined bast fibers obtained in any conventional manner such as by refining raw bast fibers with water or enzyme-containing water may be used for the purpose of the present invention.

According to the method of the present invention, the bast fiber material is digested with an aqueous cooking liquor composed of (a) hydrogen peroxide or a compound capable of generating hydrogen peroxide in the presence of water, (b) an alkali metal carbonate, and (c) an oxalate.

Hydrogen peroxide serves to function as a lignin-removing agent. In addition to hydrogen peroxide, there may also be used a compound capable of generating hydrogen peroxide upon contact with water. Examples of such hydrogen peroxide-donating compounds include sodium peroxide, potassium peroxide, a peroxoborate such as sodium peroxoborate or potassium peroxoborate, and a peroxocarbonate such as sodium peroxocarbonate or potassium peroxocarbonate. The concentration of the hydrogen peroxide in the cooking liquor is preferably 0.02–0.8 mol per liter, more preferably 0.05–0.4 mol per liter.

Since hydrogen peroxide is unstable and is readily decomposed under an acidic or alkaline condition, an alkali metal carbonate is added to the cooking liquor so that the cooked mixture after the completion of the cooking has a pH of 5–9, preferably 6–8. Illustrative of suitable alkali metal carbonates are sodium carbonate and potassium carbonate. The alkali metal carbonate also serves as a lignin-removing agent. The concentration of the alkali metal carbonate is preferably 0.02–0.2 mol per liter, more preferably 0.04–0.12 mol per liter.

The oxalate in the cooking liquor can act as a pectin-removing agent. Sodium oxalate and potassium oxalate are suitable examples of the oxalates. Oxalic acid may also be used as long as the pH of the resulting cooking liquor at an end point of the cooking falls within the above-specified range. The cooking liquor preferably has an oxalate concentration of 0.01–0.1 mol per liter, more preferably 0.02–0.08 mol per liter.

Since hydrogen peroxide is also decomposed upon contact with a heavy metal such as iron or manganese and since the raw bast fibers sometimes contain such metals in a small amount, it is preferred that the cooking liquor further contain a hydrogen peroxide stabilizing agent such as phosphate (e.g. sodium metaphosphate and sodium tripolyphosphate), an organic chelating agent (e.g. ethylenediamine tetraacetic acid and diethylenetriamine pentaacetic acid) or sodium polysilicate (e.g. water glass). Above all, the organic chelating agent is preferred because even a small quantity thereof can give a satisfactory hydrogen peroxide stabilizing effect. The use of water glass is also preferred since it can greatly facilitate the removal of lignin and pectin and since it exhibits a buffer action to maintain the cooking liquor in a neutral pH region so that the amounts of the oxalate and alkali metal carbonate can be reduced. The use of water glass in conjunction with the organic chelating agent provides especially preferable results.

For the purpose of accelerating the removal of lignin, an anthraguinone or its derivative may be suitably incorporated in the cooking liquor in an amount of preferably 0.15–3 g/liter, more preferably 0.3–1.2 g/liter. Examples of suitable anthraquinone derivatives include alkylanthraquinones such as methylanthraquinone, ethylanthraquinone, tert-butylanthraquinone or amylanthraquinone, and partially hydrogenated anthraquinone or alkylanthraquinones.

The digestion of the bast fiber material is carried out by reacting a mixture of the fiber material with the above cooking liquor at a temperature of from 60° C. to the boiling point of the liquor, preferably 80–100° C. It is especially preferable to perform the digestion reaction with stirring. In this case, it is advisable to cut the fiber material to a length of 150 mm or less, more preferably 1–120 mm, most peferably 3–50 mm prior to the initiation of the digestion. By using such a cut material, the stirring can be effected smoothly and the reaction can proceed in an accelerated manner.

More specifically, the use of a cut bast fiber material makes it possible to forcibly vigorously stir the reaction mixture by means of, for example, a propeller stirrer. Therefore, the peripheral surfaces of the fiber material which have been digested are mechanically renewed by the stirring so that the cooking liquor can be contacted with fresh, nontreated surfaces thereby to allow the digestion to proceed swiftly toward the center of the fiber. On the other hand, when long bast fibers are used, it becomes impossible to continue the stirring because the fibers are entwined with each other. The stirring may be suitably effected by means of a rotating blade stirrer rotatable at a rate of 3–300 r.p.m.

The liquor ratio (ratio of the volume of the cooking liquor to the weight of the bast fiber material on dry basis) is preferably 2–15 liter/kg, more preferably 4–10 liter/kg, though it may vary with the concentration of the cooking liquor. Generally, the use of too large an amount of the cooking liquor lowers the stirring efficiency and, therefore, the digestion speed is reduced. Too small an amount of the digestion liquid prevents the reaction from proceeding homogeneously.

The digestion is preferably performed under ambient pressure for 0.5–10 hours, more preferably 0.5–5 hours, most preferably 0.5–2 hours. After the completion of the digestion, the reaction mixture is subjected to a separating treatment to separate a pulp product from dirt, shivers, specks and knot residues. To facilitate the separation, the reaction mixture may be diluted with water prior to the sepration. The separation may be suitably effected by classification using, for example, a flat screen or by means of a liquid cyclone. From the pulp-containing liquid thus obtained pulp is recovered by, for example, scooping with wire. The pulp thus obtained has a high brightness and does not require any post treatment such as a maceration treatment by means of a pulper and a bleaching treatment.

The sole FIGURE is a schematic illustration of a pulping apparatus according to the present invention.

Bast fibers are fed to a cutter 1 and the cut fibers are introduced into a reactor 2 equipped with a stirrer 3 and a heating jacket 4, where they are cooked at an elevated temperature with stirring. The cooked mixture is then fed to a separating zone including a screen 5 and wire 6. Knot residues (rejects) or the like dirts are removed by the screen 5 and pulp is recovered by scooping or filtering with the wire 6.

The following examples will further illustrate the present invention.

EXAMPLE 1

Refined bast fibers (1 kg on the dry basis) obtained by removing epidermises from mitsumata bast and refining the endodermises with running water were cut into a length of about 25 mm and the cut fibers were placed in a 20 liter-stainless steel reactor equipped with a stirrer and a heater. To the reactor was then fed a cooking liquor having the following composition to provide a liquor ratio of 10 liter/kg:

| | |
|---|---|
| Sodium carbonate | 80 g |
| Sodium oxalate | 100 g |
| Hydrogen peroxide (as pure $H_2O_2$) | 70 g |
| DTPA | 3 g |
| t-Butylanthraquinone | 1 g |
| Water | balance |

The mixture in the reactor was then reacted at 90° C. for 90 minutes while stirring it at a rate of 150 revolutions per minute. The resulting digestion mixture was then diluted with 3 g per liter of water and subjected to separation with a flat screen (12 cut/1000 inch) and then with a net to recover a pulp product with a yield of 72.4%. The pulp product as such was very white and had a brightness by Hunter of 85.5% and a kappa No. of 22.4. The residues remaining on the screen were composed mostly of rejects and a small amount of residual epidermises and dirts. The yield of the rejects was 0.4%.

EXAMPLE 2

Example 1 was repeated in the same manner as described except that the amounts of the sodium carbonate, hydrogen peroxide and sodium oxalate were increased to 100 g, 200 g and 100 g, respectively and that the digestion was performed without stirring for 5 hours. The yields of the pulp product and the rejects were 72.4% and 1.8%, respectively. The pulp product had a kappa No. of 24.3 and a Hunter brightness of 84.6%.

EXAMPLE 3

Refined bast fibers (1 kg on the dry basis) obtained by removing epidermises from mitsumata bast and refining the endodermises with running water were cut into a length of about 45 mm and the cut fibers were placed in a 20 liter-stainless steel reactor equipped with a stirrer and a heater. To the reactor was then fed a a cooking liquor having the following composition to provide a liquor ratio of 8 liter/kg:

| | |
|---|---|
| Sodium carbonate | 80 g |
| Sodium oxalate | 30 g |
| Hydrogen peroxide (as pure $H_2O_2$) | 70 g |
| DTPA | 1 g |
| Water glass (as solid content) | 70 g |
| Water | balance |

The mixture in the reactor was then reacted at 90° C. for 60 minutes while stirring it at a rate of 150 revolutions per minute. The resulting digestion mixture was then diluted with 1 g per liter of water and subjected to a separation treatment with a flat screen (12 cut/1000 inch) and wire to recover a pulp product with a yield of 73.0%. The pulp product as such was very white and had a brightness by Hunter of 85.4% and a kappa No. of 19.0. The residues remaining on the screen were composed mostly of rejects and a small amount of residual epidermises and dirts. The yield of the rejects was 0.4%.

EXAMPLE 4

Example 3 was repeated in the same manner as described except that raw bast fibers obtained by removing epidermises of a bast of Wikstroemia sikokiana and cut to a length of 50 mm were used in place of the refined mitsumata bast fibers. The pulp yield was 74.1% and the rejects yield was 0.6%. The pulp thus obtained had a kappa No. of 27.4 and a Hunter brightness of 84.2%.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all the changes which come within the meaning and range of equivalency of the claims are therefore intended to be embraced therein.

We claim:

1. A process for the production of a pulp by removal of lignin and pectin from a bast fiber material, comprising reacting a mixture of the bast fiber material and an aqueous cooking liquor at a temperature of 60–130° C., said cooking liquor including (a) hydrogen peroxide or a compound capable of generating hydrogen peroxide in the presence of water in an amount sufficient to remove lignin, (b) an alkali metal carbonate in an amount sufficient to control pH, and (c) an oxalate in an amount sufficient to remove pectin.

2. A process as claimed in claim 1, wherein said cooking liquor further includes a hydrogen peroxide stabilizing agent selected from the group consisting of phosphates, organic chelating agents and sodium polysilicates.

3. A process as claimed in claim 2, wherein said stabilizing agent is water glass.

4. A process as claimed in claim 1, wherein said reaction is carried out with stirring.

5. A process as claimed in claim 4, wherein said stirring is by means of a rotating blade stirrer rotating at a rate of 3–300 r.p.m.

6. A process as claimed in claim 1, wherein wherein said cooking liquor has a hydrogen peroxide concentration of 0.02–0.8 mol per liter.

7. A process as claimed in claim 1, wherein said cooking liquor has an alkali metal carbonate concentration of 0.02–0.2 mol per liter.

8. A process as claimed in claim 1, wherein said cooking liquor has an oxalate concentration of 0.01–0.1 mol per liter.

9. A process as claimed in claim 1, wherein said bast fiber material is an endodermis of a bast of a plant selected from the group consisting of mitsumata, a paper mulberry, Wikstroemia sikokiana and Brossonetia kajinoki or a bast fiber of a flax.

10. A process as claimed in claim 1, wherein said cooking liquor further includes anthraquinone or a derivative thereof.

11. A process as claimed in claim 1, wherein said cooking liquor is used in an amount of 2–15 liters per 1 kg of said fiber material on dry basis.

12. A process as claimed in claim 1, further comprising cutting said bast fiber material to a length of 150 mm or less prior to said reaction.

13. A process as claimed in claim 1, wherein said reaction is performed under ambient pressure for 0.5–10 hours.

14. The process of claim 1 wherein said temperature is 80–100° C.

* * * * *